US007841115B2

(12) United States Patent
Saunders-Singer

(10) Patent No.: US 7,841,115 B2
(45) Date of Patent: Nov. 30, 2010

(54) MOUNTING SYSTEMS

(75) Inventor: Harry Saunders-Singer, Somerset (GB)

(73) Assignee: Nokia Corporation, Espoo (FI)

( * ) Notice: Subject to any disclaimer, the term of this patent is extended or adjusted under 35 U.S.C. 154(b) by 120 days.

(21) Appl. No.: 12/077,353

(22) Filed: Mar. 17, 2008

(65) Prior Publication Data

US 2008/0229640 A1 Sep. 25, 2008

(51) Int. Cl.
*G09F 7/04* (2006.01)

(52) U.S. Cl. ..... 40/600; 40/711; 40/735; 40/605

(58) Field of Classification Search ..... 40/600, 40/711, 735, 605
See application file for complete search history.

(56) References Cited

U.S. PATENT DOCUMENTS 2,940,606 A * 6/1960 Kurnitz ..... 211/183
3,965,599 A * 6/1976 Ebner ..... 40/711
5,172,504 A * 12/1992 De Maat et al. ..... 40/605
5,269,083 A * 12/1993 Vampatella et al. ..... 40/711
5,329,717 A * 7/1994 Follis ..... 40/605
5,502,907 A * 4/1996 Wang ..... 40/711
6,775,935 B1 * 8/2004 Cohen et al. ..... 40/600
2003/0056413 A1 * 3/2003 Wiemer et al. ..... 40/730
2003/0121193 A1 * 7/2003 Kim ..... 40/711
2003/0233778 A1 * 12/2003 Gross ..... 40/711
2006/0174529 A1 * 8/2006 Sachs-Lavery ..... 40/711
2008/0115397 A1 * 5/2008 Reinold et al. ..... 40/711

* cited by examiner

*Primary Examiner*—Gary C Hoge
(74) *Attorney, Agent, or Firm*—Alfred A. Fressola; Ware, Fressola, Van Der Sluys & Adolphson LLP

(57) ABSTRACT

A mounting system for displaying planar articles (13) comprising a plate (10) of a magnetic material, a plurality of fingers (12) projecting from the plate (10), the fingers (12) having co-planar support surfaces, and magnets (14) that can be placed in register with the support surfaces so that corners of the planar articles (13) are sandwiched between the magnets (14) and the support surfaces of the fingers (12).

5 Claims, 6 Drawing Sheets

MOUNTING SYSTEMS

FIELD OF THE INVENTION

This invention relates to mounting systems for displaying photographs, cards, pictures, prints, posters, notes, films and the like. Such a mounting system is hereinafter referred to for convenience as a mounting system for displaying planar articles.

It is an object of the present invention to provide an improved form of mounting system.

SUMMARY OF THE INVENTION

According to a first aspect of the present invention there is provided a mounting system for displaying planar articles comprising a plate of a magnetic material, a plurality of fingers projecting from the plate, the fingers having co-planar support surfaces, and magnets that can be placed in register with the support surfaces so that corners of the planar articles are sandwiched between the magnets and the support surfaces.

A plurality of openings are preferably formed in the plate, which is conveniently of a ferromagnetic material, preferably stainless steel, and the fingers are preferably disposed around the openings.

The openings are typically of rectangular form and the fingers are preferably at the corners of the openings.

According to a second aspect of the present invention there is provided a mounting system for displaying planar articles comprising a plate of a magnetic material, the plate having a substantially planar presented support surface, a plurality of tabs projecting from the plate from the side thereof opposite to the presented support surface, the tabs having co-planar presented surfaces, and magnets that can be placed in over corners of the planar articles so that the corners of the planar articles are sandwiched between the magnets and the presented support surface of the plate.

A plurality of openings are preferably formed in the plate, and the plate is preferably formed of stainless steel.

The tabs preferably project from the plate adjacent the corners of the openings, which may be of generally square form.

A plurality of plates may be joined together to form a cube or other three-dimensional form on which a plurality of photographs can be mounted or for the mounting of photographs or coloured films around a lamp.

The mounting system may also be used as a point of sale display and the term "planar articles" is to be interpreted as including articles that include a generally planar portion.

DESCRIPTION OF THE PREFERRED EMBODIMENTS

Figure 1:
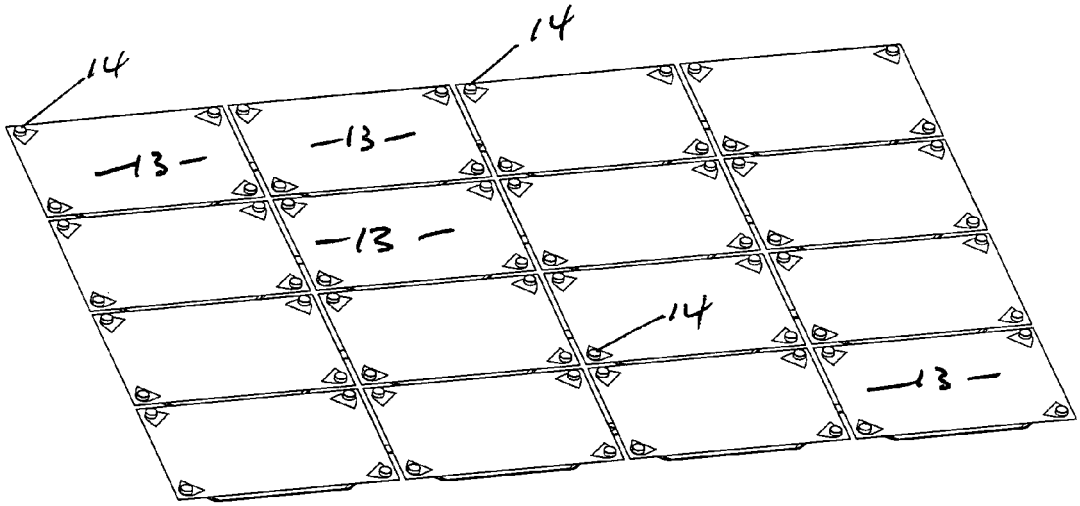
FIG. 1 is a perspective view showing a mounting system in accordance with a first embodiment of the invention supporting and displaying an array of photographs.
Figure 2:
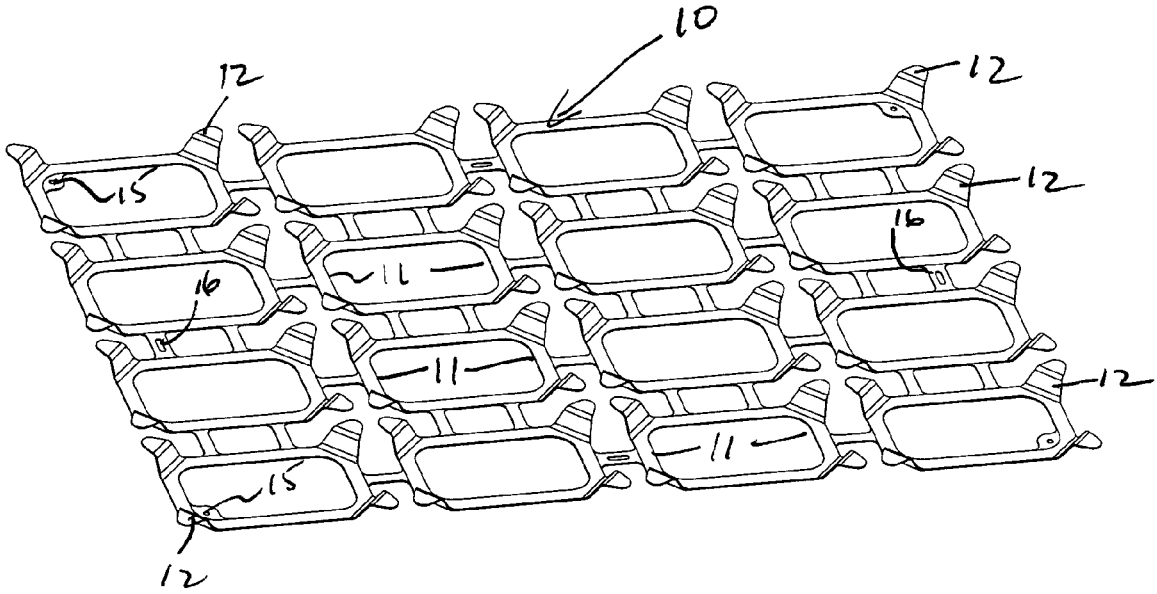
FIG. 2 is a perspective view of a formed stainless steel plate of the embodiment shown in FIG. 1.
Figure 3:
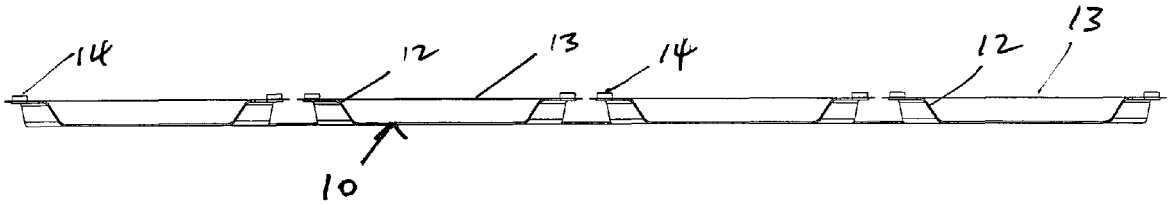
FIG. 3 is a sectional view of the mounting system shown in FIG. 1.

The mounting system shown in FIGS. 1 to 3 includes a perforated formed steel plate 10 having a plurality of generally rectangular openings 11. The formation of the openings 11 serves to reduce the weight of the display system. At each corner of each opening 11, there is an up-standing raised mounting finger 12 having a planar presented support surface. The mounting fingers 12 support the photographs 13 and, as shown, the photographs 13 are of such size that one photograph 13 is supported by the fingers 12 surrounding each individual opening 11. It will be appreciated that the mounting system could be used, for example, for supporting photographs, cards or posters having a size corresponding to two, four or six or more openings 11.

Small rare-earth disc magnets 14 are placed over the corners of each photograph 13 so that the corners of the photographs 13 are sandwiched between the magnets 14 and the support surfaces of the mounting fingers 12. The magnets 14 are visible from the front of the display but, as they are relatively small and are located at the corners of the photographs 13, they do not detract from the aesthetic appeal of the photographs 13.

The steel plate 10 is provided with through apertures 15 adjacent the corners thereof so that it can be fastened by screws or nails to a supporting substrate (not shown). It can also be bonded to, or suspended from, a supporting substrate and a pair of slots 16 are accordingly formed in the steel plate 10 to facilitate suspension of the steel plate 10.

In use, the steel plate 10 is concealed by the display of photographs 13 but the fingers 12 hold the display of photographs 13 at some distance from the supporting substrate giving the impression of a substantial frame.

Figure 4:
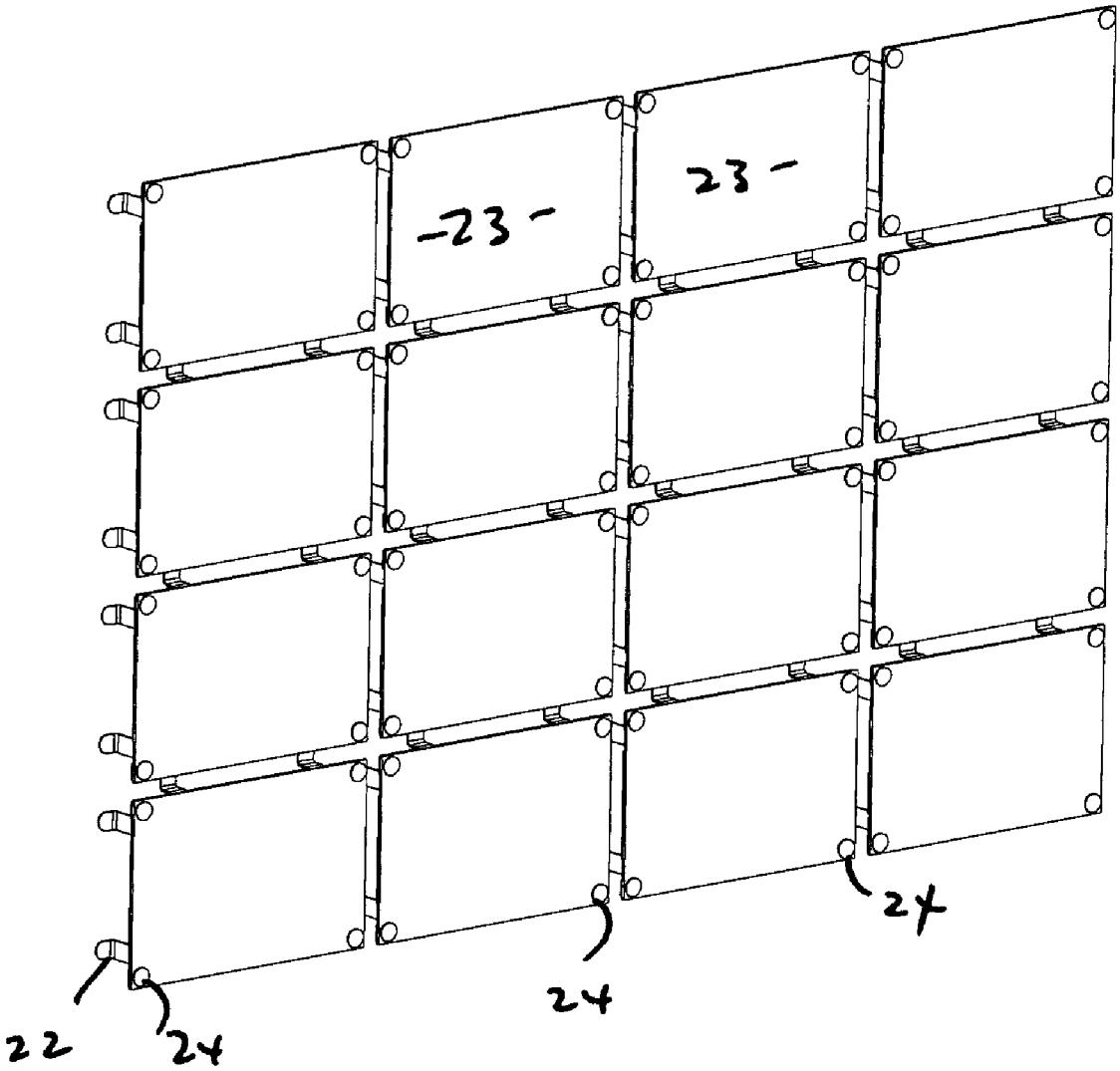
FIG. 4 is a perspective view showing a mounting system in accordance with a second embodiment of the invention supporting and displaying an array of photographs.
Figure 5:
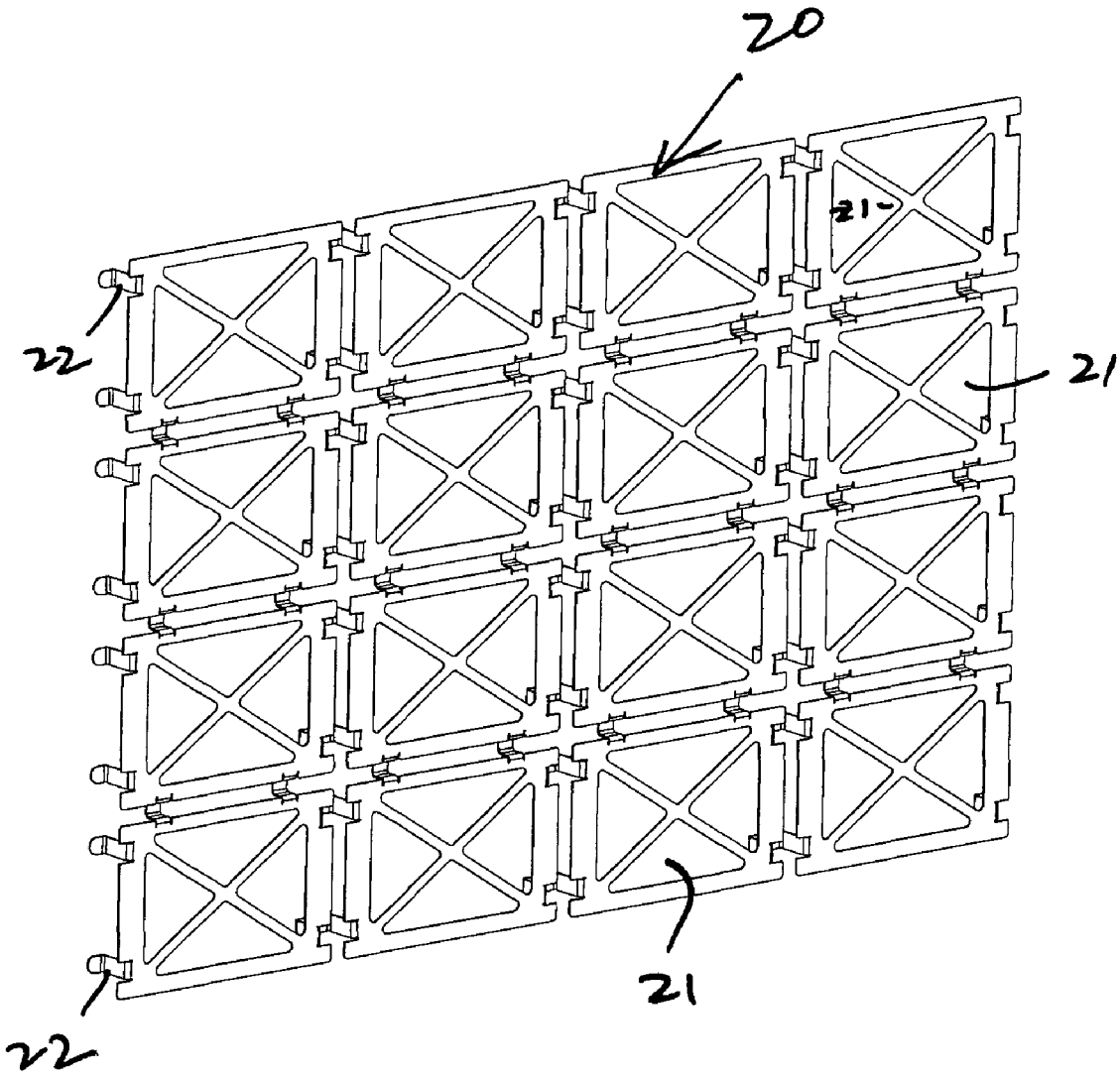
FIG. 5 is a first perspective view of a formed stainless steel plate of the embodiment shown in FIG. 4.
Figure 6:
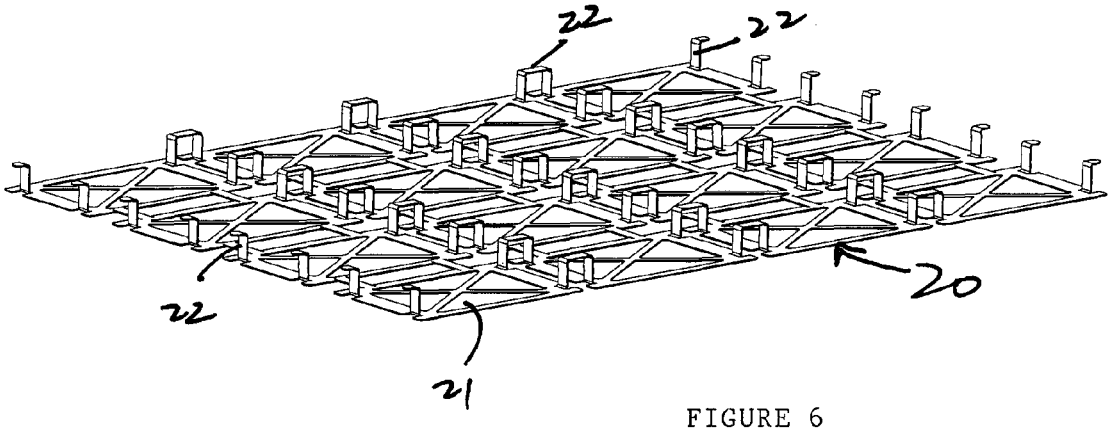
FIG. 6 is another perspective view of the formed steel plate of FIG. 5, showing the opposite side of the steel plate.

The mounting system shown in FIGS. 4 to 6 includes a perforated formed steel plate 20 having a plurality of generally square openings 21, with diagonal strips extending between opposite corners of the square openings 21. The formation of the openings 21 serves to reduce the weight of the display system. Adjacent the corners of the openings 21, there are rearwardly extending tabs 22 having co-planar presented surfaces. The configurations of the tabs 22 are best shown in FIG. 6 and they project from the main body of the plate 20 from the side thereof opposite to that against which the photographs 23 are placed.

As shown, the photographs 23 are of such size that one photograph 23 registers with each individual opening 21. It will be appreciated that the mounting system could be used, for example, for supporting photographs, cards or posters having a size corresponding to two, four or six or more openings 21.

Small rare-earth disc magnets 24 are placed over the corners of each photograph 23 so that the corners of the photographs 23 are sandwiched between the magnets 24 and the adjacent surface of the steel plate 20. The magnets 24 are visible from the front of the display but, as they are relatively small and are located at the corners of the photographs 23, they do not detract from the aesthetic appeal of the photographs 23.

The steel plate 20 may be provided with through apertures adjacent the corners thereof so that it can be fastened by screws or nails to a supporting substrate (not shown). It can also be bonded to, or suspended from, a supporting substrate.

In use, the steel plate 20 is concealed by the display of photographs 23 but the tabs 22 hold the display of photographs 23 at some distance from the supporting substrate giving the impression of a substantial frame.

The particular embodiments illustrated are intended to display an array of sixteen standard-sized photographs but other embodiments may be arranged to support the photographs or the like in some other regular or irregular array, and may be arranged to support photographs of different sizes or even a single poster.

A number of steel plates may be secured together to form a mounting frame for supporting, for example, a cube of photographs. An alternative frame design could comprise a plurality of plates joined together to form a cube or other three-dimensional form for the mounting of photographs or coloured films around a lamp.

The invention claimed is:

1. A mounting system for displaying planar articles comprising a plate of a magnetic material, having a plurality of openings formed in the plate, a plurality of fingers disposed around the openings and projecting from the plate, said openings being of generally rectangular form with the fingers located at each of the corners of the openings, the fingers having co-planar support surfaces, and magnets that can be placed in register with the support surfaces so that corners of the planar articles are sandwiched between the magnets and the support surfaces.

2. A mounting system as claimed in claim 1, in which the plate is formed of stainless steel.

3. A mounting system for displaying planar articles comprising a plate of a magnetic material, having a plurality of openings formed in the plate, each of said plurality of openings having a plurality of corners, the plate having a substantially planar presented support surface, a plurality of tabs projecting from the plate from the side thereof opposite to the presented support surface and adjacent each of the corners of the openings, the tabs having co-planar presented surfaces, and magnets that can be placed in over corners of the planar articles so that the corners of the planar articles are sandwiches between the magnets and the presented support surface of the plate.

4. A mounting system as claimed in claim 3, in which the plate is formed of stainless steel.

5. A mounting system as claimed in claim 3, in which the openings are of generally square form.

* * * * *

UNITED STATES PATENT AND TRADEMARK OFFICE

CERTIFICATE OF CORRECTION

PATENT NO. : 7,841,115 B2
APPLICATION NO. : 12/077353
DATED : November 30, 2010
INVENTOR(S) : Harry Saunders-Singer It is certified that error appears in the above-identified patent and that said Letters Patent is hereby corrected as shown below:

1. On the Title page of the patent, at item (73) please correct the Assignee's name as follows:

-- Assignee: Singer Instrument Company Limited --

2. On the Title page of the patent, please insert Item (30) foreign application priority data as follows:

-- (30) Foreign Application Priority Data
   March 22, 2007 (UK) 0705470.3 --

Signed and Sealed this
Twenty-fourth Day of January, 2012

David J. Kappos

David J. Kappos
*Director of the United States Patent and Trademark Office*